US006812453B2

(12) United States Patent
Bateman et al.

(10) Patent No.: US 6,812,453 B2
(45) Date of Patent: Nov. 2, 2004

(54) MASS SPECTROMETER

(75) Inventors: Robert Harold Bateman, Knutsford Cheshire (GB); Kevin Giles, Timperley (GB); Steve Pringle, Hoddlesden Darwen (GB)

(73) Assignee: Micromass UK Limited, Manchester (GB)

( * ) Notice: Subject to any disclaimer, the term of this patent is extended or adjusted under 35 U.S.C. 154(b) by 101 days.

(21) Appl. No.: 10/178,346

(22) Filed: Jun. 25, 2002

(65) Prior Publication Data

US 2003/0001088 A1 Jan. 2, 2003

(30) Foreign Application Priority Data

| | | |
|---|---|---|
| Jun. 25, 2001 | (GB) | 0115409 |
| Aug. 9, 2001 | (GB) | 0119449 |
| Aug. 17, 2001 | (GB) | 0120111 |
| Aug. 17, 2001 | (GB) | 0120121 |

(51) Int. Cl.[7] ..... H01J 49/00

(52) U.S. Cl. ..... 250/287; 250/281; 250/282; 250/289

(58) Field of Search ..... 250/287, 281, 250/282, 289, 292, 296

(56) References Cited

U.S. PATENT DOCUMENTS

| | | | | |
|---|---|---|---|---|
| 5,206,506 | A | 4/1993 | Kirchner | |
| 5,572,035 | A | 11/1996 | Franzen | |
| 5,811,800 | A | 9/1998 | Franzen et al. | |
| 5,818,055 | A | 10/1998 | Franzen | |
| 5,847,386 | A | 12/1998 | Thomson et al. | |
| 5,905,258 | A | 5/1999 | Clemmer et al. | |
| 6,107,628 | A | 8/2000 | Smith et al. | |
| 6,403,953 | B2 * | 6/2002 | Whitehouse et al. | 250/288 |
| 6,417,511 | B1 | 7/2002 | Russ, IV et al. | |
| 6,489,610 | B1 * | 12/2002 | Barofsky et al. | 250/287 |
| 6,545,268 | B1 | 4/2003 | Verentchikov et al. | |
| 6,559,444 | B2 | 5/2003 | Franzen | |
| 2002/0063207 | A1 | 5/2002 | Bateman et al. | |
| 2002/0063209 | A1 | 5/2002 | Bateman et al. | |
| 2002/0063210 | A1 | 5/2002 | Bateman et al. | |
| 2002/0079443 | A1 | 6/2002 | Krutchinsky et al. | |
| 2002/0113207 | A1 | 8/2002 | Lee et al. | |
| 2002/0148959 | A1 | 10/2002 | Weiss et al. | |

FOREIGN PATENT DOCUMENTS

| | | |
|---|---|---|
| CA | 2281405 | 3/2000 |
| GB | 2315364 | 1/1998 |
| GB | 2373630 | 9/2002 |
| GB | 2375653 | 11/2002 |
| JP | 11-307040 | 11/1999 |
| JP | 2000-113852 | 4/2000 |
| JP | 2000-123780 | 4/2000 |
| WO | 94/01883 | 1/1994 |
| WO | WO 97/49111 | 12/1997 |
| WO | WO 02/43105 | 5/2002 |

OTHER PUBLICATIONS

K. Fuhrer et al., "Mobility Spectrometer ", Pub. No: 2001/0032929 A1, published Oct. 25, 2001.*

Gerlich, "Rf Ion Guide", Encyclopedia of Mass Spectrometry, vol. 5 Chemistry and Physics of Gas–Phase Ions, pp. 1–34, 2003.

(List continued on next page.)

*Primary Examiner*—John R. Lee
*Assistant Examiner*—Zia R. Hashmi
(74) *Attorney, Agent, or Firm*—Diederiks & Whitelaw, PLC

(57) ABSTRACT

An ion guide is disclosed wherein a travelling DC wave is passed along the length of the ion guide so that ions exit the ion guide having substantially the same velocity.

57 Claims, 2 Drawing Sheets

OTHER PUBLICATIONS

Giles et al., "Evaulation of a Stacked–Ring Radio Frequency Ion Transmission Device at Intermediate Pressures", ASMS, 2001.

Luca et al., "On the Combination of a Linear Field Free Trap With a Time–Of–Flight Mass Spectrometer", Review of Scientific Instruments, vol. 72, No. 7, pp. 2900–2908, 2001.

Kim et al., "Design and Implementation of a New Electrodynamic Ion Funnel", Analytical Chemistry, vol. 72, No. 10, pp. 2247–2255, 2000.

Shaffer et al., "Characterization of an Improved Electrodynamic Ion Funnel Interface for Electrospray Ionization Mass Spectrometry", Analytical Chemistry, vol. 71, No. 15, pp. 2957–2964, 1999.

Shaffer et al., "An Ion Funnel Interface for Improved Ion Focusing and Sensitivity Using Electrospray Ionization Mass Spectrometry". Analytical Chemistry, vol. 70, No. 19, pp. 4111–4119, 1998.

Shaffer et al., "A Novel Ion Funnel for Focusing Ions at Elevated Pressure Using Electrospray Ionization Mass Spectrometry", Rapid Communications in Mass Spectrometry, vol. 11, pp. 1813–1817, 1997.

Shaffer et al., "Novel Ion Funnel for Ion Focusing at Elevated Pressures", ASMS Book of Abstracts, pp. 375, 1975.

Franzen et al., "Stacked–Ring Electrostatic Ion Guide", Journal American Society for Mass Spectrometry, vol. 7, pp. 101–106, 1996.

Guan et al., "Stacked–Ring Electrostatic Ion Guide", Journal American Society for Mass Spectrometry, vol. 7, pp. 101–106, 1996.

Gerlich et al., "Ion trap Studies of Association Processes in Collisions of $CH_3$, and $DC_3$- with n–$H_2$, p–$H_2$, $D_2$, and He at 80 K", The Astrophysical Journal, vol. 347, pp. 849–854, 1989.

Teloy et al., "Integral Cross Sections For Ion–Molecule Reactions, I. The Guided Beam Technique", Chemical Physics, pp. 417–427, 1974.

Gerlich, "Inhomogeneous RF Fields: A Versatile Tool For the Study of Processes With Slow Ions", Advances in Chemical Physics Series, vol. 82, pp. 1–176, 1992.

* cited by examiner

SEGMENTS
IONS IN
IONS OUT

DIRECTION OF WAVE

CONSTANT AXIAL DC

MASS SPECTROMETER

BACKGROUND OF THE INVENTION

The present invention relates to mass spectrometers.

Orthogonal acceleration time of flight ("oaTOF") mass spectrometers sample ions travelling in a first (axial) direction by periodically applying a sudden accelerating electric field in a second direction which is orthogonal to the first direction. Because the ions have a non-zero component of velocity in the first direction, the result of the pulsed electric field is that ions are accelerated into the field free or drift region of the time of flight mass analyser at an angle θ with respect to the second direction. If the ions have an initial energy eVa in the first direction, and they are accelerated to an energy eVo in the orthogonal direction, then $\tan(\theta)=(Va/Vo)^{0.5}$. For a continuous stream of ions travelling in the axial direction, all with the same energy eVa, the ion sampling duty cycle of the orthogonal acceleration time of flight mass analyser is typically of the order of 20–30% for ions having the maximum mass to charge ratio. The duty cycle is less for ions with lower mass to charge ratios. For example, if it is assumed that the length of the pusher region of the time of flight mass analyser is L1, the length of the detector is at least L1 (to eliminate unnecessary losses at the detector) and the distance between the pusher and the detector is L2, then if ions with the maximum mass to charge ratio have an mass to charge ratio mo, then the duty cycle Dcy for ions with a mass to charge ratio m is given by: $Dcy=L1/(L1+L2).(m/mo)^{0.5}$. Accordingly, if L1=35 mm and L2=120 mm, then $L1/(L1+L2)=0.2258$. Hence the maximum duty cycle is 22.6% for ions with the maximum mass to charge ratio mo, and is correspondingly less for ions with lower mass to charge ratios.

SUMMARY OF THE INVENTION

According to a first aspect of the present invention, there is provided a mass spectrometer comprising:

an ion guide wherein in use a DC potential travels along a portion of the ion guide.

As will be explained in more detail below, the ion guide with a travelling DC wave is particularly advantageous in that all the ions preferably exit the ion guide with essentially the same velocity. The ion guide can therefore be advantageously coupled to an orthogonal acceleration time of flight mass analyser which can be operated in conjunction with the ion guide so as to have an ion sampling duty cycle of nearly 100% across the whole mass range i.e. the ion sampling duty cycle is improved by a factor of approximately ×5 and furthermore is substantially independent of the mass to charge ratio of the ions. This represents a significant advance in the art.

Most if not all of the electrodes forming the ion guide are connected to an AC or RF voltage supply. The resulting AC or RF electric field acts to radially confine ions within the ion guide by creating a pseudo-potential well. According to less preferred embodiments, the AC or RF voltage supply may not necessarily output a sinusoidal waveform, and according to some embodiments a non-sinusoidal RF waveform such as a square wave may be provided. Preferably, at least 10%, 20%, 30%, 40%, 50%, 60%, 70%, 80%, 90%, or 95% of the electrodes are connected to both a DC and an AC or RF voltage supply.

According to the preferred embodiment, a repeating pattern of DC electrical potentials is superimposed along the length of the ion guide such as to form a periodic waveform. The waveform is caused to travel along the ion guide in the direction in which it is required to move the ions at constant velocity. In the presence of a gas the ion motion will be dampened by the viscous drag of the gas. The ions will therefore drift forwards with the same velocity as that of the travelling waveform and hence ions will exit from the ion guide with substantially the same velocity, irrespective of their mass.

The ion guide preferably comprises a plurality of segments. The ion guide is preferably segmented in the axial direction such that independent transient DC potentials can be applied, preferably independently, to each segment. The DC travelling wave potential is preferably superimposed on top of the AC or RF radially confining voltage and any constant or underlying DC offset voltage which may be applied to the segment. The DC potentials at which the various segments are maintained are preferably changed temporally so as to generate a travelling DC potential wave in the axial direction.

At any instant in time a moving DC voltage gradient is generated between segments so as to push or pull the ions in a certain direction. As the DC voltage gradient moves along the ion guide, so do the ions.

The DC voltage applied to each of the segments may be independently programmed to create a required waveform. The individual DC voltages on each of the segments are preferably programmed to change in synchronism such that the waveform is maintained but shifted in the direction in which it is required to move the ions.

The DC voltage applied to each segment may be programmed to change continuously or in a series of steps. The sequence of DC voltages applied to each segment may repeat at regular intervals, or at intervals that may progressively increase or decrease. The time over which the complete sequence of voltages is applied to a particular segment is the cycle time T. The inverse of the cycle time is the wave frequency f. The distance along the RF ion guide over which the waveform repeats itself is the wavelength λ. The wavelength divided by the cycle time is the velocity v of the wave. Hence, the wave velocity, $v=\lambda/T=\lambda f$. Under correct operation the velocity of the ions will be equal to that of the travelling wave. For a given wavelength, the wave velocity may be controlled by selection of the cycle time. The preferred velocity of the travelling wave may be dependent on a number of parameters. Such parameters may include the range of ion masses to be analysed, the pressure and composition of the bath gas and the maximum collision energy where fragmentation is to be avoided. The amplitude of the travelling DC waveform may progressively increase or decrease towards the exit of the ion guide. Alternatively, the DC waveform may have a constant amplitude. In one embodiment the amplitude of the DC waveform grows to its full amplitude over the first few segments of the ion guide. This allows ions to be introduced and caught up by the travelling wave with minimal disruption to their sequence.

One application of the preferred ion guide is to convert a continuous ion beam into a synchronised pulsed beam of ions. The ability to be able to convert a continuous beam of ions into a pulsed beam of ions is particularly advantageous when using an orthogonal acceleration time of flight mass analyser since it allows the pulsing of an orthogonal acceleration time of flight mass spectrometer to be synchronised with the arrival of ions at the orthogonal acceleration region. The delay time between the time the ions exit the travelling wave ion guide and the pulsing of the orthogonal acceleration stage of the time of flight mass spectrometer depends on the distance to be travelled and the ion velocity. If all the ions have the same velocity, irrespective of their mass, then the ion sampling duty cycle will be optimised for all ions simultaneously, irrespective of their mass.

Another application of the preferred ion guide is to convert an asynchronous pulsed ion beam into a synchronous pulsed ion beam. The travelling wave ion guide may be used to collect and organise an essentially random series of ion pulses into a new series with which an orthogonal acceleration time of flight mass analyser may be synchronised. Again, if all the ions have the same velocity, irrespective of their mass, then the ion sampling duty cycle may be optimised for all ions simultaneously, irrespective of their mass.

Preferably, ions are not substantially fragmented within the ion guide so that all the ions received by the ion guide are essentially onwardly transmitted. The ion guide is therefore preferably not used as a fragmentation cell.

The ion guide may comprise a plurality of rod segments (i.e. electrodes which do not have apertures) or more preferably the ion guide may comprise an ion tunnel ion guide. An ion tunnel ion guide comprises a plurality of electrodes having apertures through which ions are transmitted in use. The electrodes may comprise ring, annular, plate or substantially closed loop electrodes. Preferably, at least 50%, 60%, 70%, 80%, 90% or 95% of the electrodes forming the ion guide have apertures which are substantially the same size or area.

The diameter of the apertures of at least 50% of the electrodes forming the ion guide is preferably selected from the group consisting of: (i) ≦20 mm; (ii) ≦19 mm; (iii) ≦18 mm; (iv) ≦17 mm; (v) ≦16 mm; (vi) ≦15 mm; (vii) ≦14 mm; (viii) ≦13 mm; (ix) ≦12 mm; (x) ≦11 mm; (xi) ≦10 mm; (xii) ≦9 mm; (xiii) ≦8 mm; (xiv) ≦7 mm; (xv) ≦6 mm; (xvi) ≦5 mm; (xvii) ≦4 mm; (xviii) ≦3 mm; (xix) ≦2 mm; and (xx) ≦1 mm.

According to a preferred embodiment, the ion guide may comprise a plurality of segments wherein each segment comprises a plurality of electrodes having apertures through which ions are transmitted and wherein all the electrodes in a segment are maintained at substantially the same DC potential and wherein adjacent electrodes in a segment are supplied with different phases of an AC or RF voltage. Such a segmented design simplifies the electronics associated with the ion guide.

The ion guide may consist of 10–20, 20–30, 30–40, 40–50, 50–60, 60–70, 70–80, 80–90, 90–100, 100–110, 110–120, 120–130, 130–140, 140–150, >150, ≧5 or ≧10 electrodes. Preferably at least 50% of the electrodes forming the ion guide are ≦3 mm, ≦2.5 mm, ≦2.0 mm, ≦1.5 mm, ≦1.0 mm or ≦0.5 mm thick. The ion guide preferably is <5 cm, 5–10 cm, 10–15 cm, 15–20 cm, 20–25 cm, 25–30 cm or >30 cm long.

A gas may be introduced into the ion guide for causing the motion of ions to be dampened preferably without substantially causing fragmentation of the ions. Alternatively, the ion guide may be located within a vacuum chamber maintained at a pressure such that the motion of ions is dampened without substantially causing fragmentation of the ions. According to all embodiments of the present invention at least a portion of the ion guide is preferably maintained, in use, at a pressure selected from the group consisting of: (i) 0.0001–100 mbar; (ii) 0.001–10 mbar; (iii) 0.01–1 mbar; (iv) >0.1 mbar; 0.1 mbar; (viii) >1 mbar; (ix) >10 mbar; and (x) <100 mbar. According to an embodiment the whole ion guide is maintained at such pressures. However, according to other embodiments only part of the ion guide is maintained at such pressures.

The travelling wave ion guide is preferably used at intermediate pressures between 0.0001 and 100 mbar, further preferably between 0.001 and 10 mbar, at which pressures the gas density will impose a viscous drag on the ions. The gas at these pressures will appear as a viscous medium to the ions and will act to slow the ions. The viscous drag resulting from frequent collisions with gas molecules helps to prevent the ions from building up excessive velocity. Consequently, the ions will tend to ride on the travelling DC wave rather than run ahead of the wave and execute excessive oscillations within the travelling potential wells.

The presence of the gas helps to impose a maximum velocity at which the ions will travel through the ion guide for a given field strength. The higher the gas pressure, the more frequent the ion-molecule collisions and the slower the ions will travel for a given field strength.

The energy of ions is dependent on their mass and the square of their velocity, and if fragmentation is to be avoided then it is desirable to keep the energy of the ions less than approximately 5–10 eV.

The preferred embodiment further comprises a time of flight mass analyser, preferably an orthogonal acceleration time of flight mass analyser. Time of flight mass analysers are discontinuous devices in that they are designed to receive a packet of ions rather than a continuous beam of ions. The time of flight analyser comprises a pusher and/or puller electrode which ejects packets of ions into a substantially field free or drift region wherein ions contained in a packet of ions are temporally separated according to their mass to charge ratio. The time taken for an ion to reach a detector is used to give an accurate determination of the mass to charge ratio of the ion in question.

Ions which exit the preferred ion guide can advantageously be arranged to reach the pusher and/or puller electrode of a time of flight mass analyser at substantially the same time. Since the ion guide produces a pulsed beam of ions, the repetition rate of the mass analyser may be matched to the waveform cycle time i.e. the repetition frequency of the DC waveform may be synchronised with the pusher pulses of the time of flight mass analyser to maximise the ion sampling duty cycle.

Since ions emitted from the ion guide will have substantially the same axial velocity, then ions of differing mass will have differing energies. If necessary, a slightly larger detector may be used in the time of flight mass analyser to accommodate ions having a spread of initial energies. Additionally and/or alternatively, the ions may be accelerated once they exit the ion guide almost immediately before reaching the pusher/puller region of the orthogonal acceleration time of flight mass analyser in order to reduce the relative energy spread of the ions. For sake of illustration only, if the ions emerge from the ion guide with constant velocity and have a range of energies from 1–10 eV then there is a 10:1 difference in axial energies between the most energetic ions and the least energetic ions. However, if all the ions are accelerated and given an additional 10 eV of energy, then the ions will have a range of energies from 11–20 eV and hence there will then only be a 1.8:1 difference in the spread of energies.

Either a continuous or pulsed ion source may be used. The ion source may comprise an Electrospray ("ESI"), Atmospheric Pressure Chemical Ionisation ("APCI"), Atmospheric Pressure Photo Ionisation ("APPI"), Matrix Assisted Laser Desorption Ionisation ("MALDI"), Laser Desorption Ionisation, Inductively Coupled Plasma ("ICP"), Electron Impact ("EI") or Chemical Ionisation ("CI") ion source.

According to the preferred embodiment, no additional (static) axial DC voltage gradient is required. However, according to less preferred embodiments a constant axial DC voltage gradient may be maintained along at least a portion of the ion guide. The travelling DC waveform would therefore be superimposed upon the underlying static axial DC voltage gradient. If an axial DC voltage gradient is maintained in use along at least a portion of the length of the ion guide, then an axial DC voltage difference of 0.1–0.5 V, 0.5–1.0 V, 1.0–1.5 V, 1.5–2.0 V, 2.0–2.5 V, 2.5–3.0 V, 3.0–3.5 V, 3.5–4.0 V, 4.0–4.5 V, 4.5–5.0 V, 5.0–5.5 V, 5.5–6.0 V, 6.0–6.5 V, 6.5–7.0 V, 7.0–7.5 V, 7.5–8.0 V, 8.0–8.5 V, 8.5–9.0 V, 9.0–9.5 V, 9.5–10.0 V or >10V may be maintained along a portion of the ion guide. Similarly, an axial static DC voltage gradient may be maintained along at least a portion of ion guide selected from the group consisting of: (i) 0.01–0.05 V/cm; (ii) 0.05–0.10 V/cm; (iii) 0.10–0.15 V/cm; (iv) 0.15–0.20 V/cm; (v) 0.20–0.25 V/cm; (vi) 0.25–0.30 V/cm; (vii) 0.30–0.35 V/cm; (viii) 0.35–0.40 V/cm; (ix) 0.40–0.45 V/cm; (x) 0.45–0.50 V/cm; (xi) 0.50–0.60 V/cm; (xii) 0.60–0.70 V/cm; (xiii) 0.70–0.80 V/cm; (xiv) 0.80–0.90 V/cm; (xv) 0.90–1.0 V/cm; (xvi) 1.0–1.5 V/cm; (xvii) 1.5–2.0 V/cm; (xviii) 2.0–2.5 V/cm; (xix) 2.5–3.0 V/cm; and (xx) >3.0 V/cm. A static axial DC voltage gradient may be used to help urge ions within the ion guide towards the downstream exit region of the ion guide. Alternatively, a static axial DC voltage gradient may be arranged which opposes the ions and helps to confine the ions to a region close to the travelling DC potential(s).

According to a second aspect of the present invention, there is provided a mass spectrometer comprising:

an ion source for emitting a beam of ions;

an ion guide comprising at least five electrodes having apertures for guiding the ions; and a voltage supply for supplying a voltage wave along the electrodes for modulating the velocity of ions passing through the ion guide.

Preferably, the phase difference between two adjacent electrodes is selected from the group consisting of: (i) <180°; (ii) <150°; (iii) <120°; (iv) <90°; (v) <60°; (vi) <50°; (vii) <40°; (viii) <30°; (ix) <20°; (x) <15°; (xi) <10°; and (xii) <5°.

Preferably, the voltage wave is a ripple or other waveform which modulates the velocity of ions passing through the ion guide so that the ions emerge with substantially the same velocity.

Preferably, ions enter the ion guide as a substantially continuous beam but emerge as packets of ions due to the voltage wave.

According to a third aspect of the present invention, there is provided a mass spectrometer comprising:

an ion source;

an ion bunching device comprising a plurality of electrodes having apertures wherein trapping potentials are not applied to either the front or rear of the ion bunching device; and a voltage supply for modulating the voltage seen by each electrode so that ions passing through the ion bunching device are urged forwards and emerge from the ion bunching device as packets of ions, each ion in the packet having substantially the same velocity.

According to a fourth aspect of the present invention, there is provided a mass spectrometer comprising:

an atmospheric pressure ion source;

an ion bunching device for receiving a substantially continuous stream of ions and for emitting packets of ions;

a voltage supply for supplying a voltage to the ion bunching device; and a time of flight mass analyser arranged downstream of the ion bunching device for receiving packets of ions emitted by the ion bunching device;

wherein the voltage supply is arranged to supply a voltage waveform which travels along at least a part of the length of the ion bunching device, the voltage waveform causing ions to be bunched together into packets of ions.

According to a fifth aspect of the present invention, there is provided a mass spectrometer comprising:

an ion guide comprising ≧10 ring or plate electrodes having substantially similar internal apertures between 2–10 mm in diameter and wherein a DC potential voltage is arranged to travel along at least part of the axial length of the ion guide.

According to a sixth aspect of the present invention, there is provided a mass spectrometer comprising:

an ion guide comprising at least three segments, wherein in a mode of operation:

electrodes in a first segment are maintained at a first DC potential whilst electrodes in second and third segments are maintained at a second DC potential; then electrodes in the second segment are maintained at the first DC potential whilst electrodes in first and third segments are maintained at the second DC potential; then electrodes in the third segment are maintained at the first DC potential whilst electrodes in first and second segments are maintained at the second DC potential;

wherein the first and second DC potentials are different.

Preferably, ions are not substantially fragmented within the ion guide.

According to a seventh aspect of the present invention, there is provided a mass spectrometer comprising:

a continuous ion source for emitting a beam of ions;

an ion guide arranged downstream of the ion source, the ion guide comprising ≧5 electrodes having apertures through which ions are transmitted in use, wherein the electrodes are arranged to radially confine ions within the apertures, wherein a travelling DC wave passes along at least part of the length of the ion guide and wherein ions are not substantially fragmented within the ion guide; and a discontinuous mass analyser arranged to receive ions exiting the ion guide.

Preferably, an additional constant axial DC voltage gradient is maintained along at least 5%, 10%, 15%, 20%, 25%, 30%, 35%, 40%, 45%, 50%, 55%, 60%, 65%, 70%, 75%, 80%, 85%, 90% or 95% of the length of the ion guide.

Preferred ion sources such as Electrospray or APCI ion sources are continuous ion sources whereas a time of flight analyser is a discontinuous device in that it preferably requires a packet of ions. The ion guide according to the preferred embodiment is effective in essentially coupling a continuous ion source with a discontinuous mass analyser such as a time of flight mass analyser.

According to an eighth aspect of the present invention, there is provided a method of mass spectrometry, comprising:

travelling a DC potential along at least a portion of an ion guide.

According to a ninth aspect of the present invention, there is provided a mass spectrometer comprising:

an ion guide comprising a plurality of electrodes, wherein the following voltages are applied to at least five of the electrodes:

(i) an AC or RF voltage so as to radially confine ions within the ion guide;

(ii) a constant DC offset voltage; and (iii) an additional DC voltage which varies with time.

Each of said electrodes may have substantially the same constant DC offset voltage (which may be OV or a positive or negative DC value) or alternatively at least some of the electrodes may be maintained at different DC offset voltages so that a constant axial DC voltage gradient is generated along at least part of the ion guide.

According to a tenth aspect of the present invention, there is provided a mass spectrometer comprising:

an RF ion guide having a plurality of segments;

an orthogonal acceleration time of flight mass analyser; and a controller which generates a DC potential which travels along at least part of the RF ion guide so as to cause ions of different mass to be ejected from the ion guide with essentially the same velocity so that they arrive at the orthogonal acceleration time of flight mass analyser at essentially the same time.

According to an eleventh aspect of the present invention, there is provided a mass spectrometer comprising:

a continuous ion source;

an ion guide having a plurality of segments wherein a DC potential is progressively passed along at least some of the segments so that a DC wave having a first frequency passes along at least a portion of the ion guide; and an orthogonal acceleration time of flight mass analyser having an injection electrode for injecting ions into a drift region, wherein the injection electrode is energised at a second frequency.

Preferably, the first frequency differs from the second frequency by less than 50%, 40%, 30%, 20%, 10%, 5%, 1% or 0.1%. According to a particularly preferred embodiment, the first frequency substantially matches the second frequency. According to other embodiments either the first frequency is substantially a harmonic frequency of the second frequency or the second frequency is substantially a harmonic frequency of the first frequency.

The DC wave may have a frequency in the range: (i) 1–5 kHz; (ii) 5–10 kHz; (iii) 10–15 kHz; (iv) 15–20 kHz; (v) 20–25 kHz; (vi) 25–30 kHz; (vii) 30–35 kHz; (viii) 35–40 kHz; (ix) 40–45 kHz; (x) 45–50 kHz; (xi) 50–55 kHz; (xii) 55–60 kHz; (xiii) 60–65 kHz; (xiv) 65–70 kHz; (xv) 70–75 kHz; (xvi) 75–80 kHz; (xvii) 80–85 kHz; (xviii) 85–90 kHz; (xix) 90–95 kHz; or (xx) 95–100 kHz. A frequency of approximately 10 kHz is particularly preferred.

Similarly, the injection electrode of the time of flight mass analyser may be energised with a frequency in the range: (i) 1–5 kHz; (ii) 5–10 kHz; (iii) 10–15 kHz; (iv) 15–20 kHz; (v) 20–25 kHz; (vi) 25–30 kHz; (vii) 30–35 kHz; (viii) 35–40 kHz; (ix) 40–45 kHz; (x) 45–50 kHz; (xi) 50–55 kHz; (xii) 55–60 kHz; (xiii) 60–65 kHz; (xiv) 65–70 kHz; (xv) 70–75 kHz; (xvi) 75–80 kHz; (xvii) 80–85 kHz; (xviii) 85–90 kHz; (xix) 90–95 kHz; or (xx) 95–100 kHz. A frequency of 5–50 kHz is preferred and a frequency of 10–40 kHz is particularly preferred.

In all embodiments of the present invention, the DC wave may have an amplitude selected from the group consisting of: (i) 0.2–0.5 V; (ii) 0.5–1 V; (iii) 1–2 V; (iv) 2–3 V; (v) 3–4 V; (vi) 4–5 V; (vii) 5–6 V; (viii) 6–7 V; (ix) 7–8 V; (x) 8–9 V; (xi) 9–10 V; (xii) 10–11 V; (xiii) 11–12 V; (xiv) 12–13 V; (xv) 13–14 V; (xvi) 14–15 V; (xvii) 15–16 V; (xviii) 16–17 V; (xix) 17–18 V; (xx) 18–19 V; and (xxii) 19–20 V. The amplitude is preferably the relative amplitude compared to any constant bias DC voltage applied to the ion guide. A relative amplitude in the range 1–15 V is preferred and asks a relative amplitude in the range of 5–10 V is particularly preferred.

Preferably, the ion guide comprises at least 4, 5, 6, 7, 8, 9, 10, 11, 12, 13, 14, 15, 16, 17, 18, 19, 20, 21, 22, 23, 24, 25, 26, 27, 28, 29 or 30 segments.

Preferably, the DC wave comprises: (i) a potential barrier; (ii) a potential well; (iii) a potential well and a potential barrier; (iv) a repeating potential barrier; (v) a repeating potential well; (vi) a repeating potential well and potential barrier; or (vii) a repeating square wave.

Preferably, the DC wave has an amplitude and the amplitude: (i) remains substantially constant; (ii) decreases with time; (iii) increases with time; or (iv) varies non-linearly with time.

According to a twelfth aspect of the present invention, there is provided a method of mass spectrometry comprising:

passing ions to an RF ion guide having a plurality of segments; and generating a DC potential which travels along at least part of the RF ion guide so as to cause ions of different mass to be ejected from the ion guide with essentially the same velocity so that they arrive at an orthogonal acceleration time of flight mass analyser at essentially the same time.

BRIEF DESCRIPTION OF THE DRAWINGS

Various embodiments of the present invention will now be described, by way of example only, and with reference to the accompanying drawings in which:

FIG. 2(*b*) shows a side view of an upper ion tunnel section;

FIG. 2(*c*) shows a plan view of an ion tunnel segment;

FIG. 3(*b*) shows a DC travelling potential barrier;

FIG. 3(*c*) shows a DC travelling potential well;

FIG. 3(*d*) shows a DC travelling potential well and potential barrier; and

FIG. 3(*e*) shows a square wave DC travelling wave.

DETAILED DESCRIPTION OF THE PREFERRED EMBODIMENTS

Figure 1:
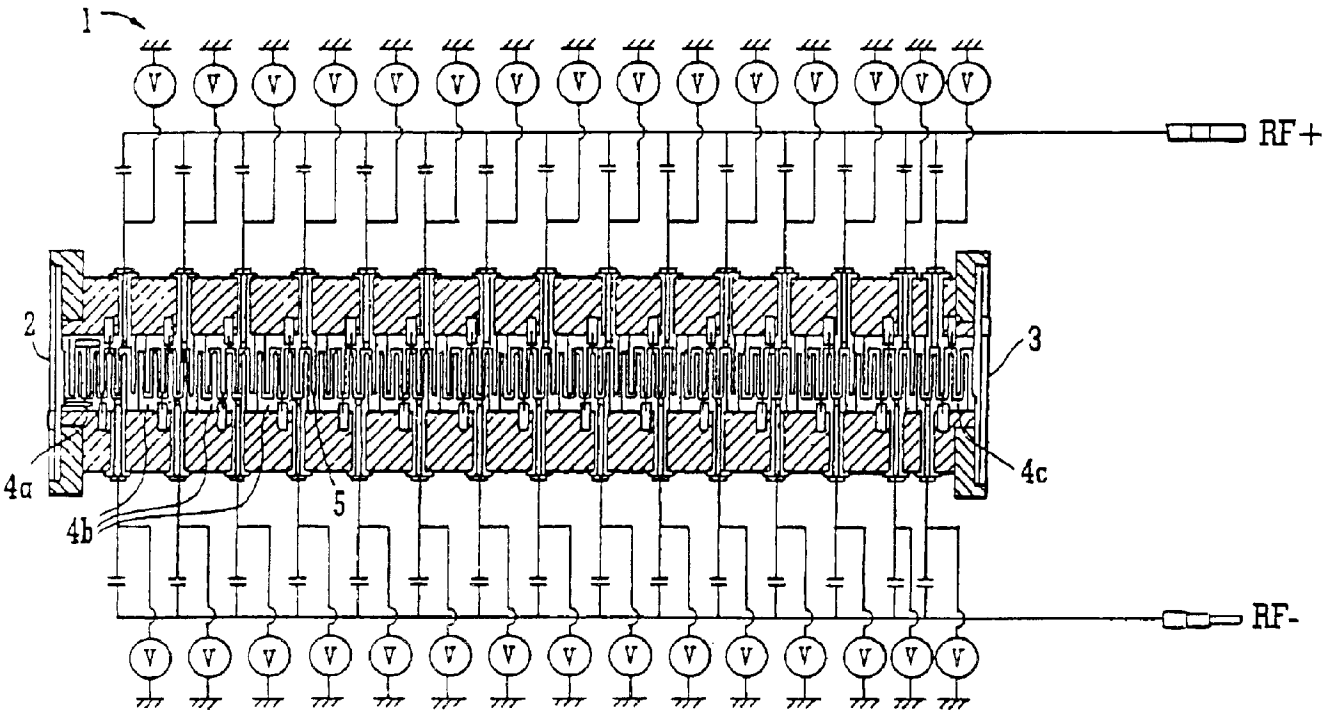
FIG. 1 shows a preferred ion tunnel ion guide wherein the DC voltage supply to each ion tunnel segment is individually controllable.

A preferred ion guide will now be described with reference to FIGS. 1 and 2. The ion guide is preferably an ion tunnel ion guide 1 comprising a housing having an entrance aperture 2 and an exit aperture 3. The entrance and exit apertures 2,3 are preferably substantially circular apertures. The plates forming the entrance and/or exit apertures 2,3 may be connected to independent programmable DC voltage supplies (not shown).

Between the plate forming the entrance aperture 2 and the plate forming the exit aperture 3 are arranged a number of electrically isolated ion tunnel segments 4*a*,4*b*,4*c*. In one embodiment fifteen segments 4*a*,4*b*,4*c* are provided. Each ion tunnel segment 4*a*;4*b*;4*c* comprises two interleaved and electrically isolated sections i.e. an upper and lower section. The ion tunnel segment 4*a* closest to the entrance aperture 2 preferably comprises ten electrodes (with five electrodes in each section) and the remaining ion tunnel segments 4*b*,4*c* preferably each comprise eight electrodes (with four electrodes in each section). All the electrodes are preferably substantially similar in that they have a central substantially circular aperture (preferably 5 mm in diameter) through which ions are transmitted. The entrance and exit apertures 2,3 may be smaller e.g. 2.2 mm in diameter than the apertures in the electrodes or the same size.

All the ion tunnel segments 4*a*,4*b*,4*c* are preferably connected to the same AC or RF voltage supply, and different segments 4*a*;4*b*;4*c* may be provided with different offset DC voltages. A time varying DC potential wave is also applied to the various segments 4*a*,4*b*,4*c* so that a travelling DC voltage wave is generated. The two sections forming an ion tunnel segment 4*a*;4*b*;4*c* are connected to different, preferably opposite, phases of the AC or RF voltage supply.

Figure 2B:
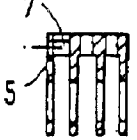
FIG. 2(*a*) shows a front view of an ion tunnel segment.
Figure 2C:
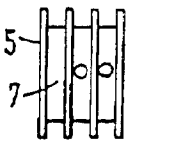
Figure 2A:
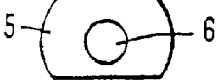

A single ion tunnel section is shown in greater detail in FIGS. 2(*a*)–(*c*). The ion tunnel section has four (or five) electrodes 5, each electrode 5 having a 5 mm diameter central aperture 6. The four (or five) electrodes 5 depend or extend from a common bar or spine 7 and are preferably truncated at the opposite end to the bar 7 as shown in FIG. 2(*a*). Each electrode 5 is typically 0.5 mm thick. Two ion tunnel sections are interlocked or interleaved to provide a total of eight (or ten) electrodes 5 in an ion tunnel segment 4*a*;4*b*;4*c* with a 1 mm inter-electrode spacing once the two sections have been interleaved. All the eight (or ten) electrodes 5 in an ion tunnel segment 4*a*;4*b*;4*c* comprised of two separate sections are preferably maintained at substantially the same DC voltage. Adjacent electrodes in an ion tunnel segment 4*a*;4*b*;4*c* comprised of two interleaved sections are connected to different, preferably opposite, phases of an AC or RF voltage supply i.e. one section of an ion tunnel segment 4*a*;4*b*;4*c* is connected to one phase (RF+) and the other section of the ion tunnel segment 4*a*;4*b*;4*c* is connected to another phase (RF−).

Each ion tunnel segment 4*a*;4*b*;4*c* is mounted on a machined PEEK support that acts as the support for the entire assembly. Individual ion tunnel sections are located and fixed to the PEEK support by means of a dowel and a screw. The screw is also used to provide the electrical connection to the ion tunnel section. The PEEK supports are held in the correct orientation by two stainless steel plates attached to the PEEK supports using screws and located correctly using dowels. These plates are electrically isolated and have a voltage applied to them. Gas may optionally be supplied to the ion guide 1 via a 4.5 mm ID tube.

An AC or RF voltage supply provides phase (RF+) and anti-phase (RF−) voltages at a frequency of preferably 1.75 MHz and is coupled to the ion tunnel sections 4*a*,4*b*,4*c* via capacitors which are preferably identical in value (100 pF). According to other embodiments the frequency may be in the range of 0.1–3.0 MHz.

The DC voltage supplied to the plates forming the entrance and exit apertures 2,3 is also preferably independently controllable and preferably no AC or RF voltage is supplied to these plates.

Figures 3A, 3B, 3C, 3D, 3E:
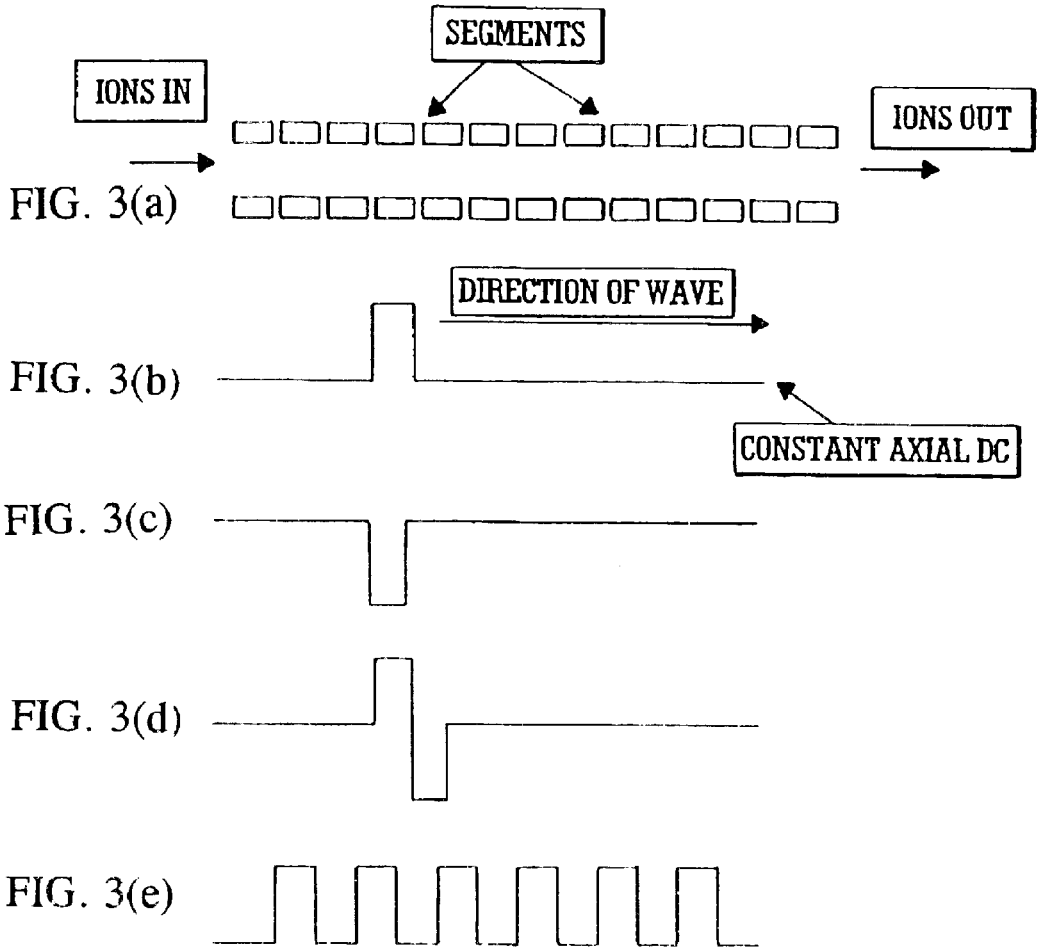
FIG. 3(*a*) shows a schematic of a segmented RF ion guide.

The transient or time varying DC voltage applied to each segment may be above and/or below that of the constant or time invariant DC voltage offset applied to the segment so as to cause movement of the ions in the axial direction. FIG. 3(*a*) shows a simplified diagram of a segmented RF ion guide and shows the direction in which ions are to move. FIGS. 3(*b*)–(*e*) show four examples of various DC travelling waves superimposed upon a constant DC voltage offset. FIG. 3(*b*) shows a waveform with a single potential hill or barrier, FIG. 3(*c*) shows a waveform with a single potential well, FIG. 3(*d*) shows a waveform with a single potential well followed by a potential hill or barrier, and FIG. 3(*e*) shows a waveform with a repeating potential hill or barrier (square wave).

Although the present invention has been described with reference to preferred embodiments, it will be understood by those skilled in the art that various changes in form and detail may be made without departing from the scope of the invention as set forth in the accompanying claims.

What is claimed is:

1. A mass spectrometer comprising:

an ion guide including a plurality of axially spaced electrodes wherein in use a DC potential travels along a portion of said ion guide and wherein the travelling DC potential causes ions to have substantially the same velocity when they exit said ion guide.

2. A mass spectrometer as claimed in claim 1, wherein an AC or RF voltage is applied to said ion guide so as to radially confine ions within said ion guide.

3. A mass spectrometer as claimed in claim 1, wherein said ion guide comprises a plurality of segments.

4. A mass spectrometer as claimed in claim 3, wherein said ion guide comprises a plurality of rod segments.

5. A mass spectrometer as claimed in claim 3, wherein said electrodes have apertures through which ions are transmitted in use.

6. A mass spectrometer as claimed in claim 5, wherein said electrodes comprise at least one of ring, annular, plate and substantially closed loop electrodes.

7. A mass spectrometer as claimed in claim 5, wherein the diameter of the apertures of at least 50% of the electrodes forming said ion guide is selected from the group consisting of:(i) ≦20 mm; (ii) ≦19 mm; (iii) ≦18 mm; (iv) ≦17 mm; (v) ≦16 mm; (vi) ≦15 mm; (vii) ≦14 mm; (viii) ≦13 mm; (ix) ≦12 mm; (x) ≦11 mm; (xi) ≦10 mm; (xii) ≦9 mm; (xiii) ≦8 mm; (xiv) ≦7 mm; (xv) ≦6 mm, (xvi) ≦5 mm; (xvii) ≦4 mm; (xviii) ≦3 mm; (xix) ≦2 mm; and (xx) ≦1 mm.

8. A mass spectrometer as claimed in wherein at least 50%, 60%, 70%, 80%, 90% or 95% of the electrodes forming the ion guide have apertures which are substantially the same size or area.

9. A mass spectrometer as claimed in claim 5, wherein said ion guide comprises a plurality of segments, each segment comprising a plurality of electrodes having apertures through which ions are transmitted and wherein all the electrodes in a segment are maintained at substantially the same DC potential and wherein adjacent electrodes in a segment are supplied with different phases of an AC or RF voltage.

10. A mass spectrometer as claimed in claim 1, wherein said ion guide is selected from the group consisting of: (i) 10–20 electrodes; (ii) 20–30 electrodes; (iii) 30–40 electrodes; (iv) 40–50 electrodes; (v) 50–60 electrodes; (vi) 60–70 electrodes; (vii) 70–80 electrodes; (viii) 80–90 electrodes; (ix) 90–100 electrodes; (x) 100–110 electrodes; (xi) 110–120 electrodes; (xii) 120–130 electrodes; (xiii) 130–140 electrodes; (xiv) 140–150 electrodes; (xv) >150 electrodes; (xvi) ≧5 electrodes; and (xvii) ≧10 electrodes.

11. A mass spectrometer as claimed in claim 1, wherein the thickness of at least 50% of the electrodes forming said ion guide is selected from the group consisting of: (i) ≦3 mm; (ii) ≦2.5 mm, (iii) ≦2.0 mm; (iv) ≦1.5 mm; (v) ≦1.0 mm; and (vi) ≦0.5 mm.

12. A mass spectrometer as claimed in claim 1, wherein at least a portion of said ion guide is maintained, in use, at a pressure selected from the group consisting of: (i) 0.0001–100 mbar; (ii) 0.001–10 mbar; (iii) 0.01–1 mbar; (iv) ≧0.0001 mbar; (v) >0.001 mbar; (vi) >0.01 mbar; (vii) >0.1 mbar (viii) >1 mbar; (ix) >10 mbar; and (x)<100 mbar.

13. A mass spectrometer as claimed in claim 1, further comprising means for introducing a gas into said ion guide for causing the motion of ions to be dampened without substantially causing fragmentation of said ions.

14. A mass spectrometer as claimed in claim 1, wherein said ion guide is located within a vacuum chamber maintained at a pressure such that the motion of ions is dampened without substantially causing fragmentation of said ions.

15. A mass spectrometer as claimed in claim 1, further comprising a time of flight mass analyser.

16. Amass spectrometer as claimed in claim 15, wherein said tune of flight mass analyser comprises an orthogonal acceleration time of flight mass analyser.

17. A mass spectrometer as claimed in claim 16, wherein said time of flight analyser comprises a pusher and/or puller electrode for ejecting packets of ions into a substantially field free or drift region wherein ions contained in a packet of ions are temporally separated according to their mass to charge ratio.

18. A mass spectrometer as claimed in claim 17, wherein ions which exit said ion guide reach said pusher and/or puller electrode at substantially the same time.

19. A mass spectrometer as claimed in Claim 1, further comprising a continuous or pulsed ion source.

20. A mass spectrometer as claimed in claim 1, further comprising an ion source selected from the group consisting of: (i) Electrospray ("EST") ion source; (ii) Atmospheric Pressure Chemical Ionisation ("APCI") ion source; (iii) Atmospheric Pressure Photo Ionisation ("APPI") ion source; (iv) Matrix Assisted Laser Desorption Ionisation ("MALDI") ion source; (v) Laser Desorption Ionisation ion source; (vi) Inductively Coupled Plasma ("ICP") ion source; (vii) Electron Impact ("EI") ion source; and (viii) Chemical Ionisation ("CI") ion source.

21. A mass spectrometer as claimed in claim 1, wherein said ion guide comprises a plurality of electrodes connected to an AC or RE voltage supply.

22. A mass spectrometer as claimed in claim 21, wherein at least 10%, 20%, 30%, 40"%, 50%, 60%, 70%, 80%, 90%, or 95% of said electrodes are connected to both a DC and an AC or RF voltage supply.

23. A mass spectrometer as claimed in claim 1, wherein said ion guide has a length selected from the group consisting of: (i) ≦5 cm; (ii) 5–10 cm; (iii) 10–15 cm; (iv) 15–20 cm; (v) 20–25 cm; (vi) 25–30 cm; and (vii) >30 cm.

24. A mass spectrometer as claimed in claim 1, wherein an axial DC voltage gradient is maintained in use along at least a portion of the length of the ion guide.

25. A mass spectrometer as claimed in claim 24, wherein an axial DC voltage difference maintained along a portion of the ion guide is selected from the group consisting of: (i) 0.1–0.5 V; (ii) 0.5–1.0 V; (iii) 1.0–1.5 V; (iv) 1.5–2.0 V; (v) 2.0–2.5 V; vi) 2.5–3.0 V; (vii) 3.0–3.5 V; (viii) 3.5–4.0 V, (ix) 4.0–4.5 V; (x) 4.5–5.0 V; (xi) 5.0–5.5 V; (xii) 5.5–6.0 V; (xiii) 6.0–6.5 V; (xiv) 6.5–7.0 V; (xv) 7.0–7.5 V; (xvi) 7.5–8.0 V; (xvii) 8.0–8.5 V; (xviii) 8.5–9.0 V; (xix) 9.0–9.5 V; (xx) 9.5–10.0 V; and (xxi) >10V.

26. A mass spectrometer as claimed in claim 24, wherein the axial DC voltage gradient maintained along at least a portion of ion guide is selected from the group consisting of: (i) 0.01–0.05 V/cm; (ii) 0.05–0.10 V/cm; (iii) 0.10–0.15 V/cm; (iv) 0.15–0.20 V/cm; (v) 0.20–0.15 V/cm; (vi) 0.25–0.30 V/cm; (vii) 0.30–0.35 V/cm; (viii) 0.35–0.40 V/cm; (ix) 0.40–0.45 V/cm; (x) 0.45–0.50 V/cm; (xi) 0.50–0.60 V/cm; (xii) 0.60–0.70 V/cm; (xiii) 0.70–0.30 V/cm; (xiv) 0.80–0.90 V/cm; (xv) 0.90–1.0 V/cm; (xvi) 1.0–1.5 V/cm; (xvii) 1.5–2.0 V/cm; (xviii) 2.0–2.5 V/cm; (xix) 2.5–3.0 V/cm; and (xx) >3.0 V/cm.

27. A mass spectrometer comprising:

an ion source for emitting a beam of ions;

an ion guide comprising at least five axially spaced electrodes having apertures for guiding said ions; and a voltage supply for supplying a voltage wave along said electrodes for modulating the velocity of ions passing through said ion guide.

28. A mass spectrometer as claimed in claim 27, wherein the phase difference between two adjacent electrodes is selected from the group consisting of: (i) <180°; (ii) <150°; (iii) <120°; (iv) <90°; (v) <60°; (vi) <50°; (vii) <40°; (viii) <30°; (ix) <20°; (x) <15°; (xi)<10°; and (xii) <5°.

29. A mass spectrometer as claimed in claim 27, wherein said voltage wave is a ripple or other waveform which modulates the velocity of ions passing through said ion guide so that the ions emerge with substantially the same velocity.

30. A mass spectrometer as claimed in claim 27, wherein ions enter said ion guide as a substantially continuous beam but emerge as packets of ions due to said voltage wave.

31. A mass spectrometer comprising:

an ion source;

an ion bunching device comprising a plurality of axially spaced electrodes having apertures wherein trapping potentials are not applied to either the front or roar of said ion bunching device; and a voltage supply for modulating the voltage seen by each electrode so that ions passing through said ion bunching device are urged forwards and emerge from said ion bunching device as packets of ions, each ion in said packet having substantially the same velocity.

32. A mass spectrometer comprising:

an atmospheric pressure ion source;

an ion bunching device for receiving a substantially continuous stream of ions and for emitting packets of ions;

a voltage supply for supplying a voltage to said ion bunching device; and a time of flight mass analyser arranged downstream of said ion bunching device for receiving packets of ions emitted by said ion bunching device;

wherein said voltage supply is arranged to supply a voltage waveform which travels along at least a part of the length of said ion bunching device, said voltage waveform causing ions to be bunched together into packets of ions.

33. A mass spectrometer as claimed in claim 32, wherein said ion bunching device comprises a plurality of ring, annular or substantially closed loop electrodes.

34. A mass spectrometer comprising:

an ion guide comprising ≧10 axially spaced ring or plate electrodes having substantially similar internal apertures between 2–10 mm in diameter and wherein a DC potential voltage is arranged to travel along at least part of the axial length of said ion guide.

35. A mass spectrometer comprising:

an ion guide comprising at least three segments, wherein in a mode of operation:

electrodes in a first segment are maintained at a first DC potential whilst electrodes in second and third segments are maintained at a second DC potential; then electrodes in said second segment are maintained at said first DC potential whilst electrodes in first and third segments are maintained at said second DC potential; then electrodes in said third segment are maintained at said first DC potential whilst electrodes in first and second segments are maintained at said second DC potential;

wherein said first and second DC potentials are different.

36. A mass spectrometer as claimed in claim 35, wherein ions are substantially not fragmented within said ion guide.

37. A mass spectrometer comprising:

a continuous ion source for emitting a beam of ions;

an ion guide arranged downstream of said ion source, said ion guide comprising ≧5 axially spaced electrodes having apertures through which ions are transmitted in use, wherein said electrodes are arranged to radially confine ions within said apertures, wherein a travelling DC wave passes along at least part of the length of said ion guide and wherein ions are not substantially fragmented within said ion guide; and a discontinuous mass analyser arranged to receive ions exiting said ion guide.

38. A mass spectrometer as claimed in claim 37, wherein an additional constant axial DC voltage gradient is maintained along at least 5%, 10%, 15%, 20%, 25%, 30%, 35%, 40%, 45%, 50%, 55%, 60%, 65%, 70%, 75%, 80%, 85%, 90% or 95% of the length of said ion guide.

39. A mass spectrometer as claimed in claim 37, wherein said continuous ion source comprises an Electrospray or Atmospheric Pressure Chemical Ionisation ion source.

40. A mass spectrometer as claimed in claim 37, wherein said discontinuous mass analyser comprises a time of flight mass analyser.

41. A method of mass spectrometry, comprising:

travelling a DC potential along at least a portion of an ion guide including a plurality of axially spaced electrodes.

42. A mass spectrometer comprising:

an ion guide comprising a plurality of axially spaced electrodes, wherein the following voltages are applied to at least five of said electrodes:

(i) an AC or RIP voltage so as to radially confine ions within said ion guide;

(ii) a constant DC offset voltage; and (iii) an additional DC voltage which varies with time.

43. A mass spectrometer as claimed in claim 42, wherein each of said electrodes has substantially the same constant DC offset voltage.

44. A mass spectrometer as claimed in claim 42, wherein at least some of said electrodes are maintained at different DC offset voltages so that a constant DC voltage gradient is generated along at least part of said ion guide.

45. A mass spectrometer comprising:

an RE ion guide having a plurality of axially spaced segments;

an orthogonal acceleration dine of flight mass analyser; and a controller which generates a DC potential which travels along at least part of the RE ion guide so as to cause ions of different mass to be ejected from said ion guide with essentially the same velocity so that they arrive at said orthogonal acceleration time of flight mass analyser at essentially the same time.

46. A mass spectrometer comprising:

a continuous ion source;

an ion guide having a plurality of axially spaced segments wherein a DC potential is progressively passed along at least some of said segments so that a DC wave having a first frequency passes along at least a portion of said ion guide; and an orthogonal acceleration time of flight mass analyser having an injection electrode for injecting ions into a drift region, wherein said injection electrode is energised at a second frequency.

47. A mass spectrometer as claimed in claim 46, wherein said first frequency differs from said second frequency by less than 50%, 40%, 30%, 20%, 10%, 5%, 1% or 0.1%.

48. A mass spectrometer as claimed in claim 46, wherein said first frequency substantially matches said second frequency.

49. A mass spectrometer as claimed in claim 46, wherein said first frequency is substantially a harmonic frequency of said second frequency.

50. A mass spectrometer as claimed in claim 46, wherein said second frequency is substantially a harmonic frequency of said first frequency.

51. A mass spectrometer as claimed in claim 48, wherein said first frequency is selected from the group of ranges consisting of: (i) 1–5 kHz; (ii) 5–10 kHz; (iii) 10–15 kHz; (iv) 15–20 kHz; (v) 20–25 kHz; (vi) 25–30 kHz; (vii) 30–35 kHz; (viii) 35–40 kHz; (ix) 40–45 kHz: (x) 45–50 kHz; (xi) 50–55 kHz; (xii) 55–60 kHz; (xiii) 60–65 kHz; (xiv) 65–70 kHz; (xv) 70–75 kHz; (xvi) 75–80 kHz; (xvii) 80–85 kHz; (xviii) 85–90 kHz; (xix) 90–95 kHz; and (xx) 95–100 kHz.

52. A mass spectrometer as claimed in claim 48, wherein said second frequency is selected from the group of ranges consisting of: (i) 1–5 kHz; (ii) 5–10 kHz; (iii) 10–15 kHz; (iv) 15–20 kHz; (v) 20–25 kHz; (vi) 25–30 kHz; (vii) 30–35 kHz; (viii) 35–40 kHz; (ix) 40–45 kHz; (x) 45–50 kHz; (xi) 50–55 kHz; (xii) 55–60 kHz; (xiii) 60–65 kHz; (xiv) 65–70 kHz; (xv) 70–75 kHz; (xvi) 75–80 kHz; (xvii) 80–85 kHz; (xviii) 85–90 kHz; (xix) 90–95 kHz; and (xx) 95–100 kHz.

53. A mass spectrometer as claimed in claim 46, wherein said DC wave has an amplitude selected from the group consisting of (i) 0.2–0.5 V; (ii) 0.5–1 V; (iii) 1–2 V; (iv) 2–3 V; (v) 3–4V; (Vi) 4–5 V; (vii) 5–6 V; (viii) 6–7 V; (ix) 7–8 V; (x) 8–9 V; (xi) 9–10 V; (xii) 10–11 V; (xiii) 11–12 V; (xiv) 12–13 V; (xv) 13–14V; (xvi) 14–15 V; (xvii) 15–16 V; (xviii) 16–17 V; (xix) 17–18 V; (xx) 18–19V; and (xxi) 19–20 V.

54. A mass spectrometer as claimed in claim 46, wherein said ion guide comprises at least 4, 5, 6, 7, 8, 9, 10, 11, 12, 13, 14, 15, 16, 17, 18, 19, 20, 21, 22, 23, 24, 25, 26, 27, 28, 29 or 30 segments.

55. A mass spectrometer as claimed in claim 46, wherein said DC wave comprises one of: (i) a potential barrier; (ii) a potential well; (iii) a potential well and a potential barrier; (iv) a repealing potential barrier; (v) a repeating potential well; (vi) a repeating potential well and potential barrier; and (vii) a repeating square wave.

56. A mass spectrometer as claimed in claim 46, wherein said DC wave his an amplitude and said amplitude: (i) remains substantially constant; (ii) decreases with time; (iii) increases with time; or (iv) varies non-linearly with time.

57. A method of mass spectrometry comprising:

passing ions to an RE ion guide having a plurality of axially spaced segments; and generating a DC potential which travels along at least part of the RF ion guide so as to cause ions of different mass to be ejected from said ion guide with essentially the same velocity so that they arrive at an orthogonal acceleration time of flight mass analyser at essentially the same time.

* * * * *